United States Patent [19]

Schuette

[11] 4,069,626

[45] Jan. 24, 1978

[54] STEEPLE

[75] Inventor: Heinz G. Schuette, Mount Clemens, Mich.

[73] Assignee: Yarema Die & Engineering Co., Troy, Mich.

[21] Appl. No.: 670,857

[22] Filed: Mar. 26, 1976

[51] Int. Cl.[2] ..... E04B 7/00; E04B 5/52

[52] U.S. Cl. ..... 52/57; 52/483; 52/462; 52/731; 52/650

[58] Field of Search ..... 52/200, 40, 697, 57, 52/38, 461, 72, 81, 648, 650, 82, 649, 462, 483

[56] References Cited

U.S. PATENT DOCUMENTS

| | | | |
|---|---|---|---|
| 2,284,898 | 6/1942 | Hartman | 52/650 |
| 2,564,061 | 8/1951 | Goble | 52/57 |
| 3,281,997 | 11/1966 | Leonard | 52/57 |
| 3,485,005 | 12/1969 | Kutchai | 52/648 |
| 3,557,422 | 1/1971 | Pfaff | 52/731 |
| 3,953,949 | 5/1976 | O'Sheeran | 52/82 |
| 3,959,946 | 6/1976 | Holmes | 52/731 |

FOREIGN PATENT DOCUMENTS

| | | | |
|---|---|---|---|
| 2,017,537 | 10/1971 | Germany | 52/57 |

*Primary Examiner*—Price C. Faw, Jr.
*Assistant Examiner*—Robert C. Farber
*Attorney, Agent, or Firm*—Harness, Dickey & Pierce

[57] ABSTRACT

A steeple adapted to be mounted to the roof of a church or comparable structure. The steeple comprises a rigid frame that is fabricated from a plurality of inclined leg members that are attached to one another by a plurality of connecting members. The rigid frame is enclosed within an aluminum housing having a contour that is complementary to the shape of the frame and received over the frame in such a manner that the housing is drawn tightly against the frame to insure its strength and rigidity. The steeple may have application for supporting apparatus in an elevated position, such as wind-driven turbines and the like.

7 Claims, 7 Drawing Figures

STEEPLE

BACKGROUND OF THE INVENTION

I. Field of the Invention

The present invention relates to the fabrication of building components and, in particular, the present invention relates to a prefabricated steeple for churches and the like.

II. Description of the Prior Art

Heretofore, it has been customary to fabricate steeples from wood, the same being generally accomplished at the site of construction. Because of the high-labor and material expenses encountered in present-day construction, the cost of conventional wooden steeples is very high. It has been suggested that wooden church steeples be manufactured on a mass-production basis employing all the techniques which would result in a less expensive steeple. However, such a suggestion has several major drawbacks. These include the cost of shipping the assembled steeple, as the assembled steeple is very heavy and thus difficult to handle and transport in a simple ane economical fashion. Additionally, the assembled, prefabricated church steeple would need to be packaged in such a manner as to protect the finished wood surface. It has been further suggested that such prefabricated church steeples be shipped in a knocked-down fashion; and while not overcoming the major disadvantage of the weight of such wooden prefabricated steeples, the bulkiness of such steeples would be eliminated. Such a situation, however, results in the necessity of requiring skilled carpenters to assemble the wooden steeple at the construction site.

Certain of the prior art structures have been fabricated from a fiberglass material; however, due to the disadvantage of the weight of such fiberglass structures, they are very difficult to handle and transport in that they require a crane for lifting the assembled steeple to the roof of the building on which such steeples are to be mounted and must be crated for shipping in order to protect the fiberglass material.

It would therefore be desirable to provide a church steeple which is of light-weight construction to facilitate the ease of shipment and handling and yet one which is inexpensive to manufacture and assemble at the construction site where the church steeple is to be employed.

SUMMARY OF THE INVENTION

The present invention, which will be described subsequently in greater detail, comprises a steeple adapted to be mounted to the roof of a church. The steeple comprises a rigid frame having inclined legs, the feet of which are adapted to be fastened to the church roof. The upper end of the rigid frame carries an upright support post which is attached to the upper portion of a housing received by the frame and support post in such a manner that the housing is drawn downwardly into a snug relationship with the frame to provide rigidity and additional structural support for the steeple.

It is therefore a primary object of the present invention to provide a new and improved prefabricated church steeple.

It is a further object of the present invention to provide such a church steeple which is simple in design and construction and easily assembled and installed by unskilled labor.

It is a further object of the present invention to provide a church steeple which is fabricated from a light-weight aluminum frame and an aluminum housing that is maintenance free.

Other objects, advantages, and applications of the present invention will become apparent to those skilled in the art of the manufacture of church steeples when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
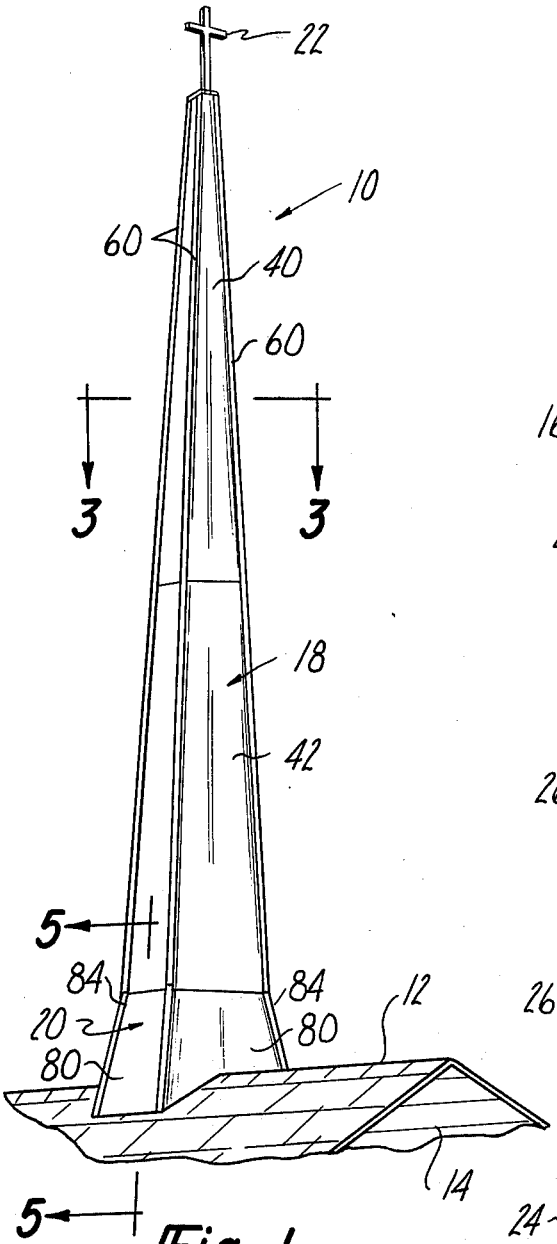
FIG. 1 is a perspective view of one example of the present invention in the form of a steeple mounted to the roof of a church building.

Referring now to the drawings and, in particular, to FIG. 1 wherein there is illustrated one example of the present invention the form of a steeple 10 mounted to the roof 12 of a building, such as a church 14. As can best be seen in FIG. 2, the steeple 10 comprises an inner frame 16 enclosed by a skin or outer housing 18. The steeple further comprises a spire base 20 and an emblem such as a cross 22 is shown carried at the top of the steeple 10, although as indicated above, other devices might be carried by the steeple.

Figure 2:
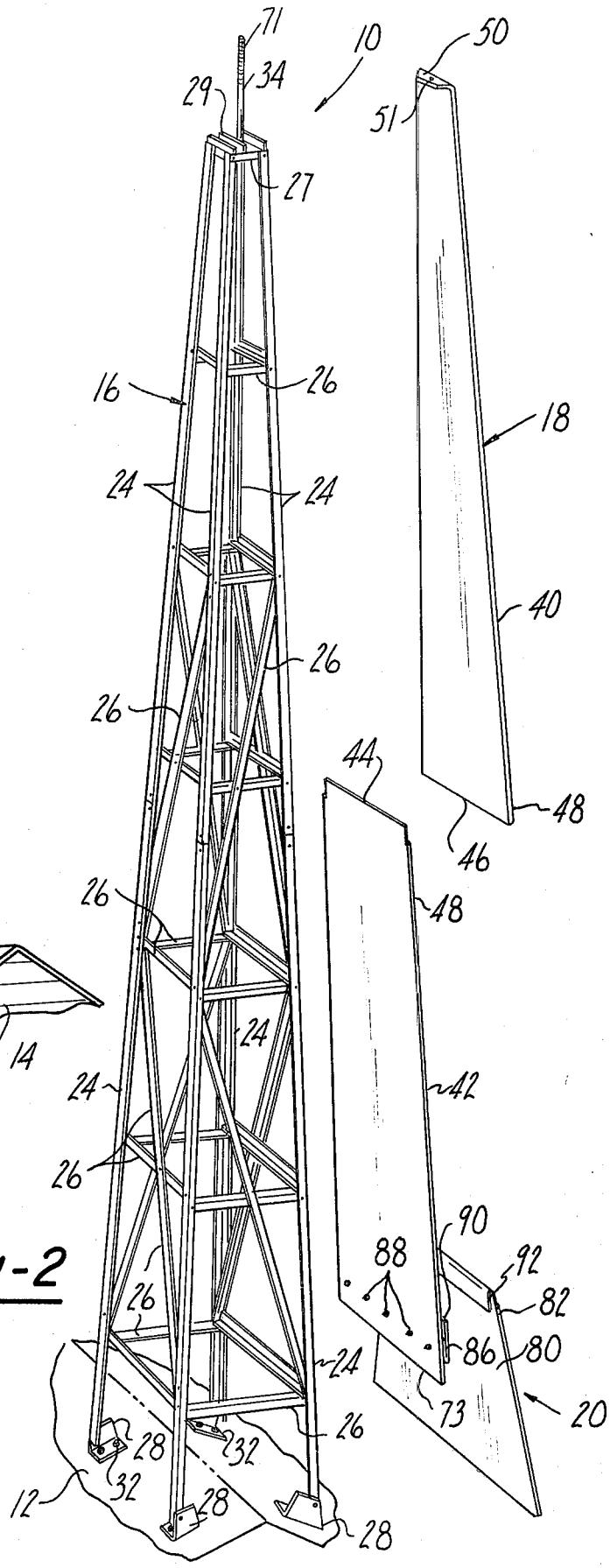
FIG. 2 is a fragmentary, partially exploded perspective view of the church steeple illustrated in FIG. 1.

As can best be seen in FIG. 2, the frame 16 comprises a plurality of inclined leg members 24 of L-section that are interconnected by a plurality of struts or connecting members 26 also of L-section to define a rigid structure in the form of the inner frame 16. The leg members 24 and connecting members 26 are joined by means of suitable fastening elements, such as conventional nuts and bolts and the like. In the preferred embodiment the frame 16, that is, the legs 24 and connecting members 26, are preferably fabricated from aluminum with the members being so arranged as to form a rigid, but light-weight, construction. It should be understood that other materials, other than aluminum, may be utilized to fabricate the skin or outer housing 18. Such materials may include the use of fiberglass and other suitable plastic materials which are strong and of light weight.

Figure 5:
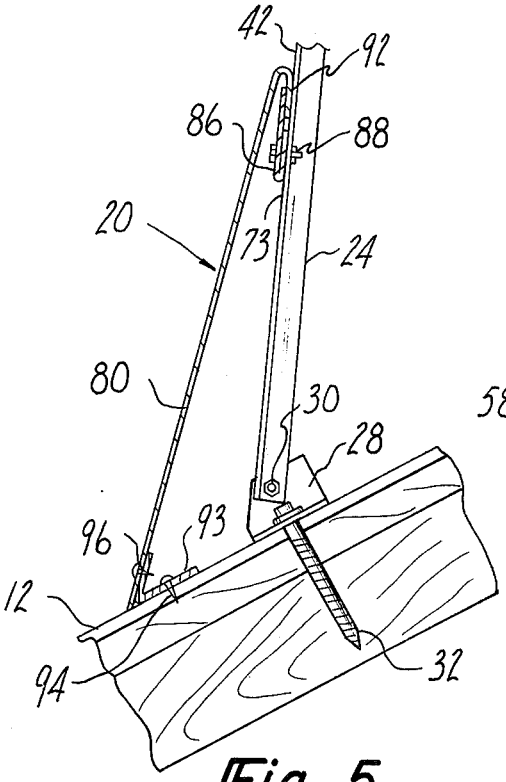
FIG. 5 is a fragmentary, longitudinal sectional view of the church steeple taken along line 5—5 of FIG. 1.

As can best be seen in FIGS. 2 and 5, the lower end of each 24 has an L-shaped coupling member 28 attached thereto by any suitable means, such as nut and bolt assembly 30. The coupling members are 28 attached to the ends of the leg members 24 so they may be inclined comformably to the pitch of the roof 12 in the fashion illustrated in FIG. 5. Suitable fastening screws 32 extend through the L-shaped coupling member 28 to securely fasten the coupling members 28 and, thus, the frame 16 to the roof 12. As will be explained in greater detail hereinafter, the upper ends of the inclined legs 24 are somewhat spaced from each other to define the corners of a square and are joined by a four horizontal L-sectioned connecting members 27 (FIG. 6) with a central transverse connecting member 29 bridges and is supported by members 27 and has an aperture 31 through which an upright support rod or post 34 extends. Suitable nuts 36 engaging the lower threaded end 38 of the supporting post 34 secure the same to the connecting member 29. As will be described in greater detail hereinafter, the support post 34 functions to secure both the outer skin or housing 18 and the emblem or cross 22 to the frame 16.

Figure 3:
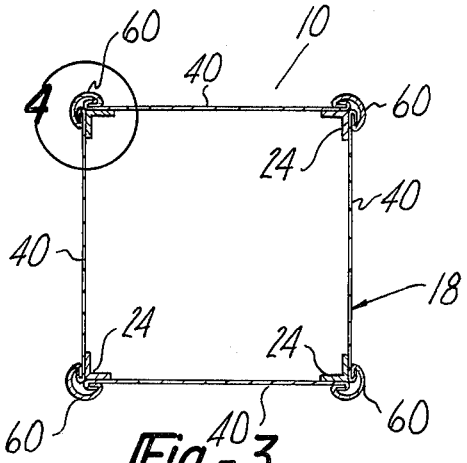
FIG. 3 is a cross-sectional view of the church steeple taken along line 3—3 of FIG. 1.
Figure 4:
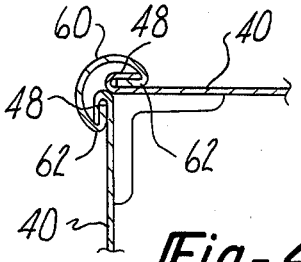
FIG. 4 is a fragmentary enlarged view of the circled portion 4 of the church steeple illustrated in FIG. 3.
Figure 6:
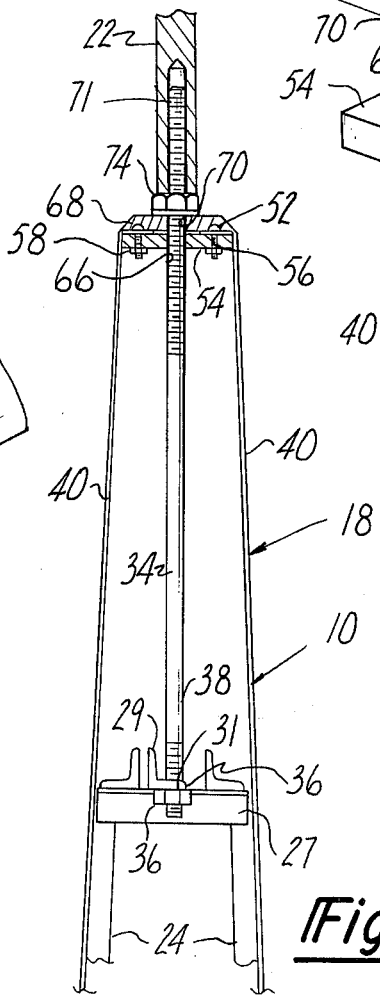
FIG. 6 is an enlarged, partially sectioned side elevational view of the church steeple illustrated in FIG. 1.
Figure 7:
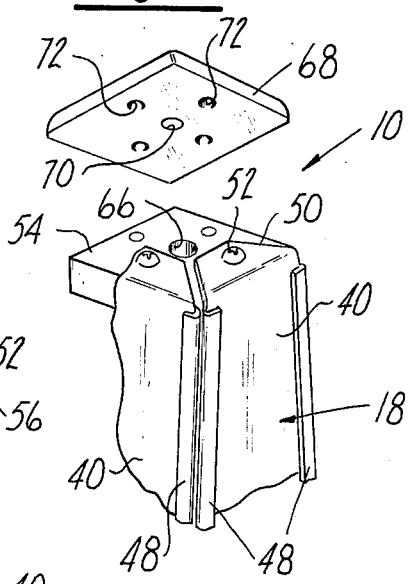
FIG. 7 is a fragmentary, partially exploded perspective view of the church steeple illustrated in FIG. 1.

Referring now to FIGS. 2, 3, and 4, wherein there is illustrated one example of the outer skin or housing 18 as comprising a plurality of trapezoidally shaped upper panels 40 and lower panels 42. The upper edge of the lower panel 42 has a section 44 which extends behind the lower edge 46 of the upper panel 40 when the two panels are joined to each other in a manner to be described hereinafter. As can be seen in FIGS. 4 and 7, the lengthwise edges of each of the panels 40 and 42 are bent inwardly toward the panel center to define a lengthwise bead 48 along each side of each panel 40 and 42 which serves a purpose that will be described hereinafter. The beads 48 each define a lengthwise slot 49. As can be seen in FIGS. 2 and 7, the upper ends of each of the upper panels 40 terminate in a right-angled inwardly bent flange 50 which is apertured at 51 (FIG. 2) to permit the passage of a threaded fastener 52. As can be best be seen in FIGS. 6 and 7, the bent end flanges 50 are secured to a plate member 54 by means of the fasteners 52 extending through bores 56 in the plate 54 and threadingly engaging conventional nuts 58 on the lower side of the plate member 54. This arrangement of positioning the upper panels 40 about the plate member 54 properly locates the lengthwise beads 48 in the side-by-side relation shown in FIGS. 3, 4, and 7.

The steeple 10 further comprises a plurality of molding channel members 60 in the form of a partly circular cross section having reentrant edge flanges lying at 90° to each other respect to the adjacent beads 48 of the each panel 40 that the bent flanges 62 of the molding 60 may be slideably received within the slots 49 of the adjacent beads 48, as shown in FIG. 4, so as to laterally secure the adjacent beads 48 to each other and thereby provide a simple means for fastening the adjacent panels 40 and 42 to one another and thereby form the housing 18. After the housing 18 has been assembled in the manner described, the housing 18 is positioned over the assembled frame 16 with a central aperture 66 in the connecting plate 54 receiving the upper end of the frame support post 34, all of which is illustrated in greater detail in FIG. 6. A second connecting plate 68 having a central aperture 70 receives the upper end of the support post 34 as the plate 68 is positioned on top of the plate 54. As can best be seen in FIG. 7, the bottom surface of the plate 68 is provided with a plurality of circular apertures 72 which are sized to receive the heads of the fastening elements 52 to permit the plate 68 to rest against the upper portions of the panel flanges 50 without interference from the heads of the fastening elements 52. As can be seen in FIG. 6, the housing structure 18 is taller than the frame structure 16 and extends upwardly to a position somewhat below the upper end of the rod or post 34. The upper end of the support rod 34 is threaded at 71 to receive a nut and washer assembly 74. It can thus be seen that as the nut and washer assembly 74 is tightened down against the upper surface of the plate 68, the entire housing 18 is drawn tightly down against the legs 24 of the frame 16 whereby the panel members assume the position illustrated in FIG. 3; that is, the sides of the panel members are in a snug or tight-fitting relationship with respect to the legs 24 and also with relation to the securing channel or molding 60 whereby the housing wall panels 40 and 42 are securely attached to one another and to the frame 16 providing for a very rigid and strengthened steeple structure 10.

Prior to raising the steeple 10 onto the roof 12, the cross 22 or other suitable object is fastened to the upper threaded end 71 of the post 34. The cross 22 is shown as having a mating threaded bore 75 to facilitate the easy mounting of the same and so that it acts as a lock nut.

The lower edge 73 of the lower panels 42 terminate at a position which is above the lower ends of the legs 24. This permits the assembled structure 10 to be raised to the roof 12 and attached to the roof by means of coupling members 28 in the aforementioned manner, as this termination of the lower edge of the panel 42 at a distance above the ends of the feet 24 provides sufficient working clearance for the workmen to attach the steeple 10 to the roof 12. It also insures that the panels and channels 40, 42, 60 may move downwardly to insure a tight fit of all of the parts, when drawn down by tightening the nut 74 on rod 34, regardless of any variations in dimensions due to tolerances and the like.

The skirt or spire base 20 is fabricated from panel members 80 which are trapezoidal in shape and are provided with lengthwise bent edges that define beads 82 which are similar in shape, construction, and purpose to the lengthwise beads 48 described hereinbefore with respect to the panels 40 and 42. Moldings 84 (FIG. 1) are received by the adjacent beads 82 of the spire base panels 80 to join the base panels to one another. The spire base 20 is positioned on the steeple 10 after it has been attached to the roof 12 and moved lengthwise down the steeple 10 until the spire 20 abuts the roof 12. As can best be seen in FIGS. 2 and 5, the lower edge of each of the lower panels 42 carries a connecting member 86. The connecting members 86 are attached to the bottom edges of the panels 42 by any suitable means, such as nut and bolt assemblies 88. Each coupling member 86 defines an upwardly opening horizontal slot 90 into which an angled downbent flange 92 formed at the upper edge of the corresponding skirt panels 80 is received so as to secure the spire base 20 to the lower edges of the panels 42. Prior to the attachment of the spire base panels 80 to the lower edge of the housing panels 42, angled bracket members 93 (FIG. 5) are attached to the roof 12 by suitable fasteners 94 at appropriate locations corresponding to the points of contact of the lower edges of the spire base 20, such that suitable fastening elements 96 may be extended through the panels 80 and bracket members 93 to secure the lower edges of the base structure to the roof 12.

It can thus be seen that the present invention has provided a new and improved steeple which is preferably fabricated from a lightweight aluminum material that is of a simple design permitting it to be assembled at the construction site and easily installed. In the preferred embodiment the housing panels are fabricated from a baked enamel aluminum with the moldings being fabricated from stainless steel; however, it should be understood that other materials, such as plastics and the like, may be utilized in the construction of the steeple 10. It should also be understood that while the steeple is disclosed as having a trapezoidal shape, other shapes may be employed in the design and construction of a steeple employing applicant's inventive methods of construction.

While only one example of the present invention has been disclosed, it should be apparent to those skilled in the art of prefabricated church steeples and the like that other forms of applicant's invention may be had without departing from the spirit of the invention or the scope of the appended claims.

What is claimed is as follows:

1. A steeple adapted to be mounted to a roof, said steeple comprising:

a plurality of inclined leg members, the lower ends of which are laterally spaced from each other a greater distance than the upper ends of said leg members;

a plurality of connecting members;

means fastening said connecting members to said leg members to define a rigid frame, the leg members defining corners of the frame and the lower ends of said leg members being adapted to be attached to a roof;

an upright support rod rigidly secured to and extending upwardly from the upper end of said frame;

an outer skin structure having a contour that is complementary to the shape of said frame, said skin being telescopically received over said frame;

means connecting the upper portion of said outer skin structure to said support rod to urge said outer skin structure downwardly into a snug-fitting relationship with said frame;

said skin structure comprising a plurality of panel members, each panel member being proportioned to overlie one side of the frame and being tapered conformably to the inclination of said leg members, said panel members having bent lengthwise edges defining a bead along each longitudinal edge thereof positioned adjacent the lengthwise bead of an adjacent panel member;

a plurality of channeled moldings have oppositely inbent lengthwise edges defining opposed converging flanges, the opposed flanges of each molding being slideably received by adjacent beads of said adjacent panel members and engaging said beads to secure said adjacent panel members to each other;

horizontal inbent flanges carried at the upper ends of said panel members;

a horizontal connection plate;

means rigidly connecting said inbent flanges to said connecting plate, said connecting plate being received by said support rod;

threadable fastening means carried by said support rod and bearing against said connecting plate for urging said plate and panel members toward said snug-fitting relationship with said frame;

the skin structure being shorter than the total length of the frame and rod and the maximum internal cross section of the skin structure being less than the maximum external cross section of the frame, whereby the skin structure attains said snug-fitting relationship while spaced above the bottom of the frame;

a spire releasably attachable to the lower edge of said outer skin structure for concealing the lower portion of said frame; and means for attaching the lower edge of said spire to a roof.

2. A steeple adapted to be mounted to a roof, said steeple comprising:

a plurality of inclined leg members, the lower ends of which are laterally spaced from each other a great distance than the upper ends of said leg members;

a plurality of connecting members;

means fastening said connecting members to said leg members to define a rigid frame, the leg members defining corners of the frame and the lower ends of said leg members being adapted to be attached to a roof;

an upright support rod rigidly secured to and extending upwardly from the upper end of aid frame;

an outer skin structure having a contour that is complementary to the shape of said frame, said skin being telescopically received over said frame;

means connecting the upper portion of said outer skin structure to said support rod to urge said outer skin structure downwardly into a snug-fitting relationship with said frame;

the skin structure being shorter than the total length of the frame and rod and the maximum internal cross section of the skin structure being less than the maximum external cross section of the frame, whereby the skin structure attains said snug-fitting relationship while spaced above the bottom of the frame.

3. A steeple adapted to be mounted to a roof, said steeple comprising:

a plurality of inclined leg members, the lower ends of which are laterally spaced from each other a greater distance than the upper ends of said leg members;

a plurality of connecting members;

means fastening said connecting members to said leg members to define a rigid frame, the leg members defining corners of the frame and the lower ends of said leg members being adapted to be attached to a roof;

an upright support rod rigidly secured to and extending upwardly from the upper end of said frame;

an outer skin structure having a contour that is complementary to the shape of said frame, said skin being telescopically received over said frame;

means connecting the upper portion of said outer skin structure to said support rod to urge said outer skin structure downwardly into a snug-fitting relationship with said frame;

said skin structure comprising a plurality of panel members, each panel member being proportioned to overlie one side of the frame and being tapered conformably to the inclination of said leg members, said panel members having bent lengthwise edges defining a bead along each longitudinal edge thereof positioned adjacent the lengthwise bead of an adjacent panel members;

a plurality of channeled moldings having oppositely inbent lengthwise edges defining opposed converging flanges, the opposed flanges of each molding being slideably received by adjacent beads of said adjacent panel members and engaging said beads to secure said adjacent panel members to each other;

the skin structure being shorter than the total length of the frame and rod and the maximum internal cross section of the skin structure being less than the maximum external cross section of the frame, whereby the skin structure attains said snug-fitting relationship while spaced above the bottom of the frame, and whereby the panel members, moldings and frame are urged into tight interengagement when the skin structure is urged downwardly.

4. A steeple adapted to be mounted to a roof, said steeple comprising:

a plurality of inclined leg members, the lower ends of which are laterally spaced from each other a greater distance than the upper ends of said leg members;

a plurality of connecting members;

means fastening said connecting members to said leg members to define a rigid frame, the leg members defining corners of the frame and the lower ends of said leg members being adapted to be attached to a roof;

an upright support rod rigidly secured to and extending upwardly from the upper end of said frame;

an outer skin structure having a contour that is complementary to the shape of said frame, said skin being telescopically received over said frame;

means connecting the upper portion of said skin structure to said support rod to urge said outer skin structure downwardly into a snug-fitting relationship with said frame;

said skin structure comprising a plurality of panel members, each panel member being proportioned to overlie one side of the frame and being tapered conformably to the inclination of said leg members, said panel members having bent lengthwise edges defining a bead along each longitudinal edge thereof positioned adjacent the lengthwise bead of an adjacent panel member;

a plurality of channeled moldings having oppositely inbent lengthwise edges defining opposed coverging flanges, the opposed flanges of each molding being slideably received by adjacent beads of said adjacent panel members and engaging said beads to secure said adjacent panel members to each other;

horizontal inbent flanges carried at the upper ends of said panel members;

a horizontal connection plate;

means rigidly connecting said inbent flanges to said connecting plate, said connecting plate being received by said support rod; and threadable fastening means carried by said support rod and bearing against said connecting plate for urging said plate and panel members toward said snug-fitting relationship with said frame; wherein the skin structure is shorter than the total length of the frame and rod and the maximum internal cross section of the skin structure is less than the maximum external cross section of the frame, whereby the skin structure attains said snug-fitting relationship while spaced above the bottom of the frame, and whereby the panel members, moldings and frame are urged into tight interengagement when the skin structure is urged downwardly by said threadable fastening means.

5. A steeple adapted to be mounted to a roof, said steeple comprising:

a plurality of inclined leg members, the lower ends of which are laterally spaced from each other a greater distance than the upper ends of said leg members;

a plurality of connecting members;

means fastening said connecting members to said leg members to define a rigid frame, the leg members defining corners of the frame and the lower ends of said leg members being adapted to be attached to a roof;

an upright support rod rigidly secured to and extending upwardly from the upper end of said frame;

an outer skin structure having a contour that is complementary to the shape of said frame, said skin being telescopically received over said frame;

means connecting the upper portion of said outer skin structure to said support rod to urge said outer skin structure downwardly into a snug-fitting relationship with said frame;

said skin structure comprising a plurality of panel members, each panel member being proportioned to overlie one side of the frame and being tapered conformably to the inclination of said leg members, said panel members having bent lengthwise edges defining a bead along each longitudinal edge thereof positioned adjacent the lengthwise bead of an adjacent panel member;

a plurality of channeled moldings having oppositely inbent lengthwise edges defining opposed converging flanges, the opposed flanges of each molding being slideably received by adjacent beads of said adjacent panel members and engaging said beads to secure said adjacent panel members to each other; wherein the panel members are flat and said beads and moldings overlie the legs at the corners of the frame.

6. A steeple as defined in claim 1 wherein the panel members are flat and said beads and moldings overlie the legs at the corners of the frame.

7. A steeple as defined in claim 4 wherein the panel members are flat and said beads and moldings overlie the legs at the corners of the frame.

* * * * *

UNITED STATES PATENT AND TRADEMARK OFFICE

CERTIFICATE OF CORRECTION

PATENT NO. : 4,069,626
DATED : Jan. 24, 1978
INVENTOR(S) : Schuette, Heinz G.

It is certified that error appears in the above-identified patent and that said Letters Patent are hereby corrected as shown below:

Column 1, line 22 after simple "ane" should be --and--

Column 2, line 62, after "each" insert --leg--

Column 2, line 65, "are 28" should be --28 are--

Column 3, line 5, after "by" delete --a--

Column 3, line 6, after (Fig. 6) delete "with a" and insert --. A--

Column 3, line 11, "supporting" should be --support--

Column 3, line 23, after "can" insert --best--

Column 3, line 32, after "can" delete --be--

Column 3, line 43, after "reentrant insert --bent-in-- and after "flanges" insert --62--

Column 3, line 44, after "other" insert --. Each molding 60 is so sized with-- and after "48 of" delete --the--

Column 3, line 45, after "bent" insert -- -in--

Column 4, line 51, after "to the" delete --lower edge of the--

Column 6, line 6, "great" should be --greater--

UNITED STATES PATENT AND TRADEMARK OFFICE

CERTIFICATE OF CORRECTION

PATENT NO. : 4,069,626

DATED : Jan. 24, 1978

INVENTOR(S) : Schuette, Heinz G.

It is certified that error appears in the above-identified patent and that said Letters Patent are hereby corrected as shown below:

Column 6, line 15, "aid" should be --said--

Column 7, line 22 after "said" insert --outer--

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*